United States Patent [19]

Taylor

[11] 4,221,299

[45] Sep. 9, 1980

[54] FOLDING DISH DRAINER

[75] Inventor: William D. Taylor, Wooster, Ohio

[73] Assignee: Rubbermaid Incorporated, Wooster, Ohio

[21] Appl. No.: 2,617

[22] Filed: Jan. 11, 1979

[51] Int. Cl.[2] ..... A47F 5/10

[52] U.S. Cl. ..... 211/41; D6/190

[58] Field of Search ..... 211/41, 40, 195; D7/188; D6/190

[56] References Cited

U.S. PATENT DOCUMENTS

| | | | |
|---|---|---|---|
| D. 231,063 | 4/1974 | Rafaat | 211/40 UX |
| 589,843 | 9/1897 | Lewis | 211/41 |
| 2,958,424 | 11/1960 | Bigatti | 211/41 |

FOREIGN PATENT DOCUMENTS

| | | | |
|---|---|---|---|
| 21396 | 10/1946 | Finland | 211/41 |

*Primary Examiner*—Roy D. Frazier
*Assistant Examiner*—Robert W. Gibson, Jr.
*Attorney, Agent, or Firm*—Hamilton, Renner & Kenner

[57] ABSTRACT

A folding dish drainer having two wings (10,11) hinged together by pins (12) and having flat inner walls (13,14) for abutting each other in folded position with angular support flanges (16,17) at their lower edges. One wing (10) has an upper extended portion comprising a series of spaced-apart arcuate ribs (30) extending laterally for supporting dishes edgewise therebetween, and walls (36,19,20) form a separate cutlery channel extending upwardly from support flange (16) into said upper extended portion. An upwardly projecting tongue (40) on wall (14) abuts wall (36) and supports the underside of the cutlery channel.

10 Claims, 7 Drawing Figures

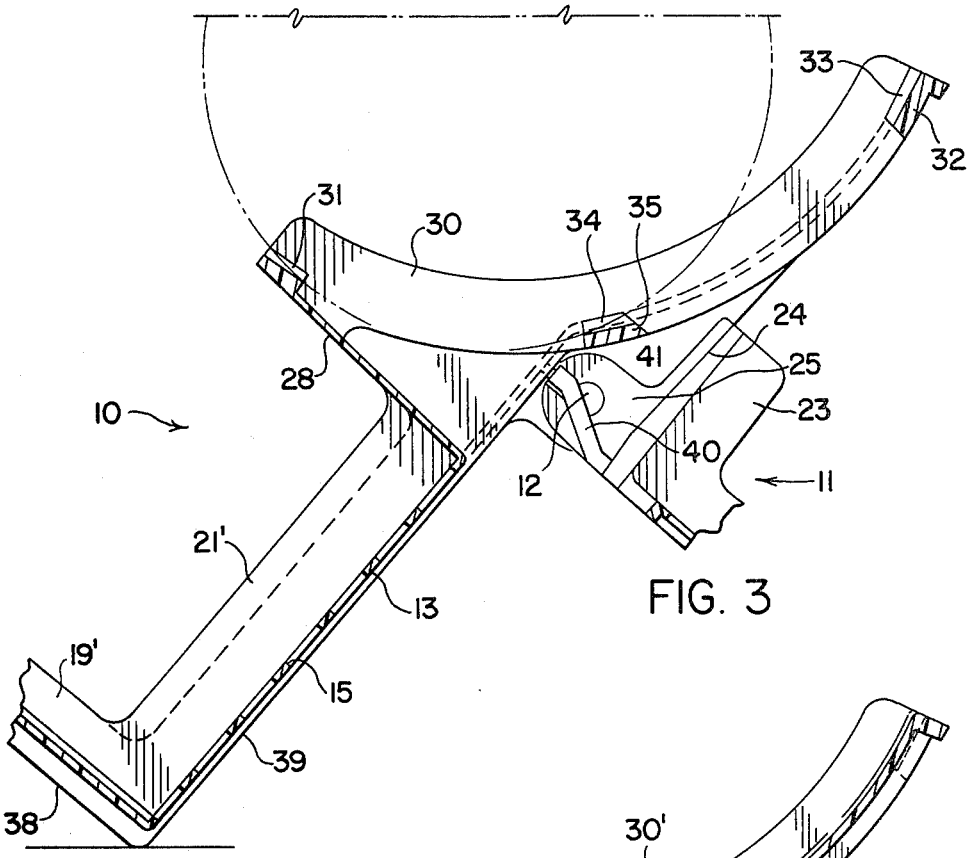
FIG. 3
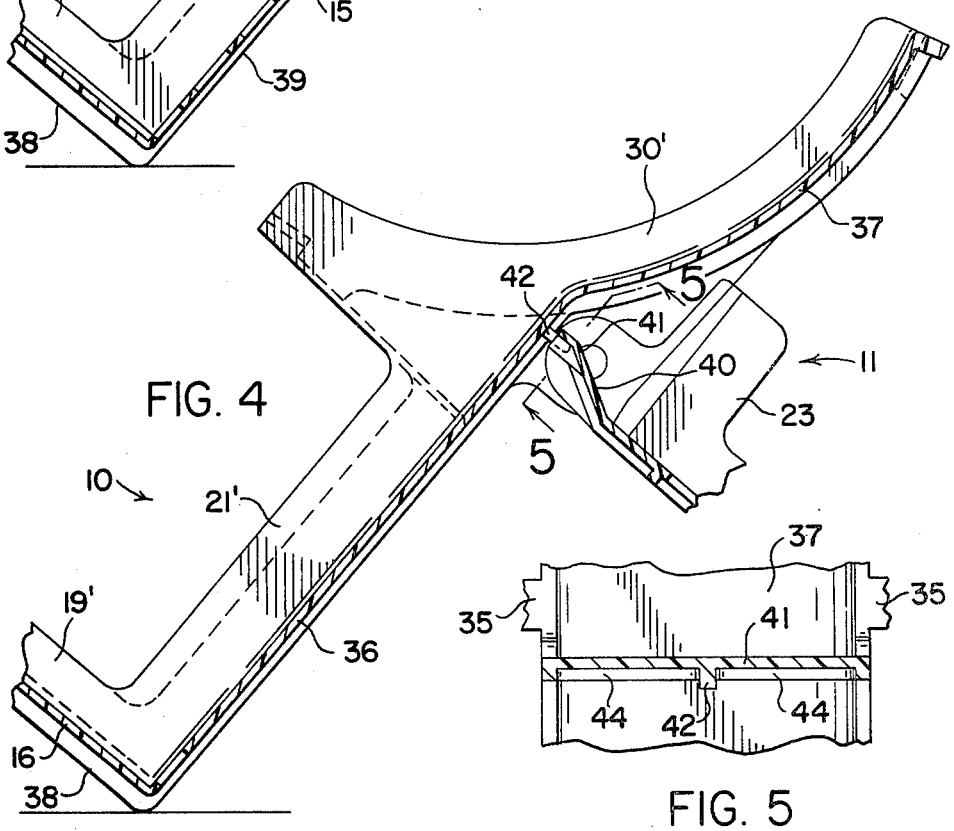
FIG. 4
FIG. 5

FOLDING DISH DRAINER

TECHNICAL FIELD

The invention relates to racks for draining dishes and glassware after washing, and more particularly to dish drainers adapted to fold and occupy a reduced amount of space when not in use.

BACKGROUND ART

Certain prior folding dish drainers have been made of plastic-coated wire and are unstable when unfolded and in use, as well as being easily bent and distorted so as not to fold properly. Prior folding dish drainers of molded plastic material have been proposed, but as far as I am aware these have had limited capacity, especially for large size dishes, and have occupied excessive vertical cupboard space when folded.

DISCLOSURE OF INVENTION

The present invention is of molded plastic material, and is designed to overcome the disadvantages of prior folding dish drainers.

More specifically, it is an object of the present invention to provide an improved compact and stable folding dish drainer of molded plastic material.

Another object is to provide a folding dish drainer of molded plastic material which has increased capacity for supporting various sizes of dishes.

A further object is to provide a folding dish drainer of molded plastic material having a separate compartment for utensils and cutlery.

A still further object is to provide an improved folding dish drainer of molded plastic material which in folded condition occupies a reduced amount of vertical space for storing in or under conventional kitchen cupboards.

These and other objects are attained by the improvements comprising the present invention, a preferred embodiment exemplifying the best known mode of carrying out the invention being disclosed in the drawings and specification hereof. Various modifications and changes in details of construction are comprehended within the scope of the appended claims.

BRIEF DESCRIPTION OF DRAWINGS

FIG. 3 is an enlarged partial sectional view as on line 3—3 of FIG. 1.

FIG. 4 is an enlarged partial sectional view as on line 4—4 of FIG. 1.

FIG. 5 is a partial sectional view on line 5—5 of FIG. 4.

PREFERRED EMBODIMENT FOR CARRYING OUT THE INVENTION

Figure 1:
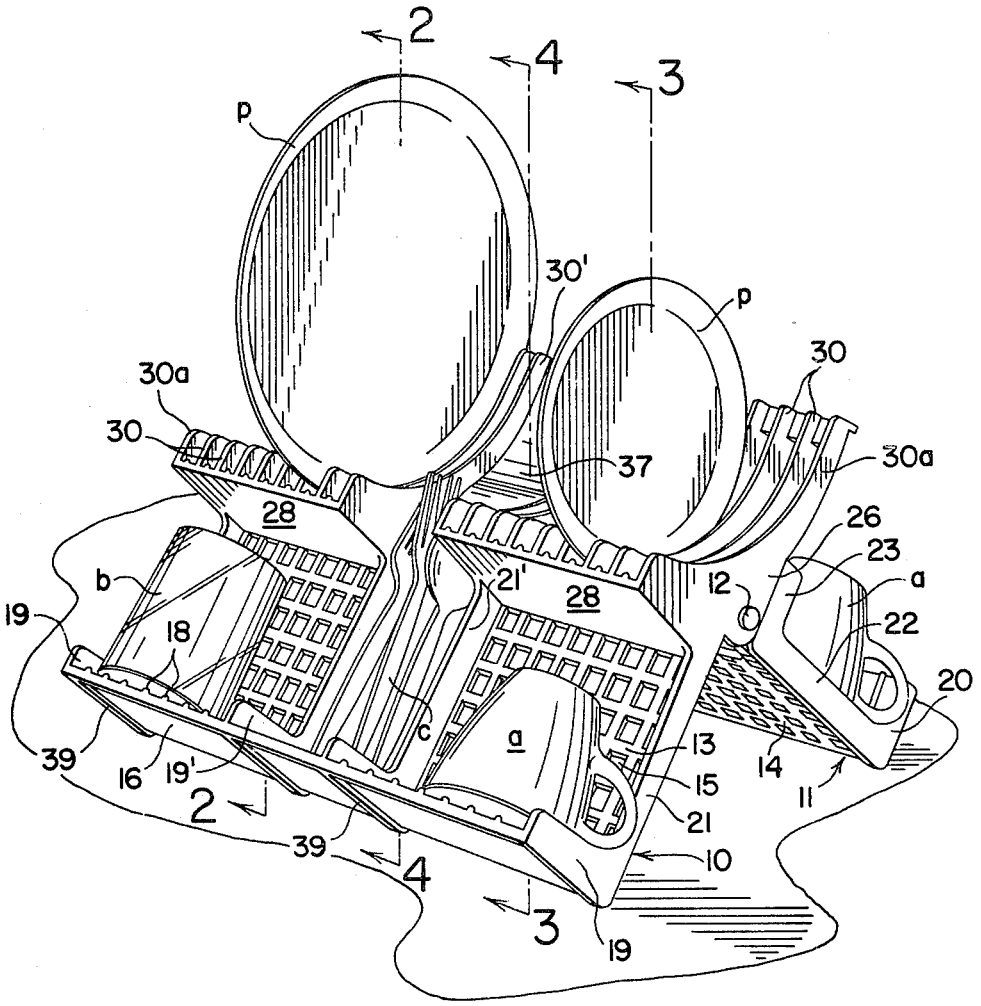
FIG. 1 is a perspective view of the improved dish drainer in unfolded position, with several dishes, cups, glasses and cutlery supported thereon.
Figure 7:
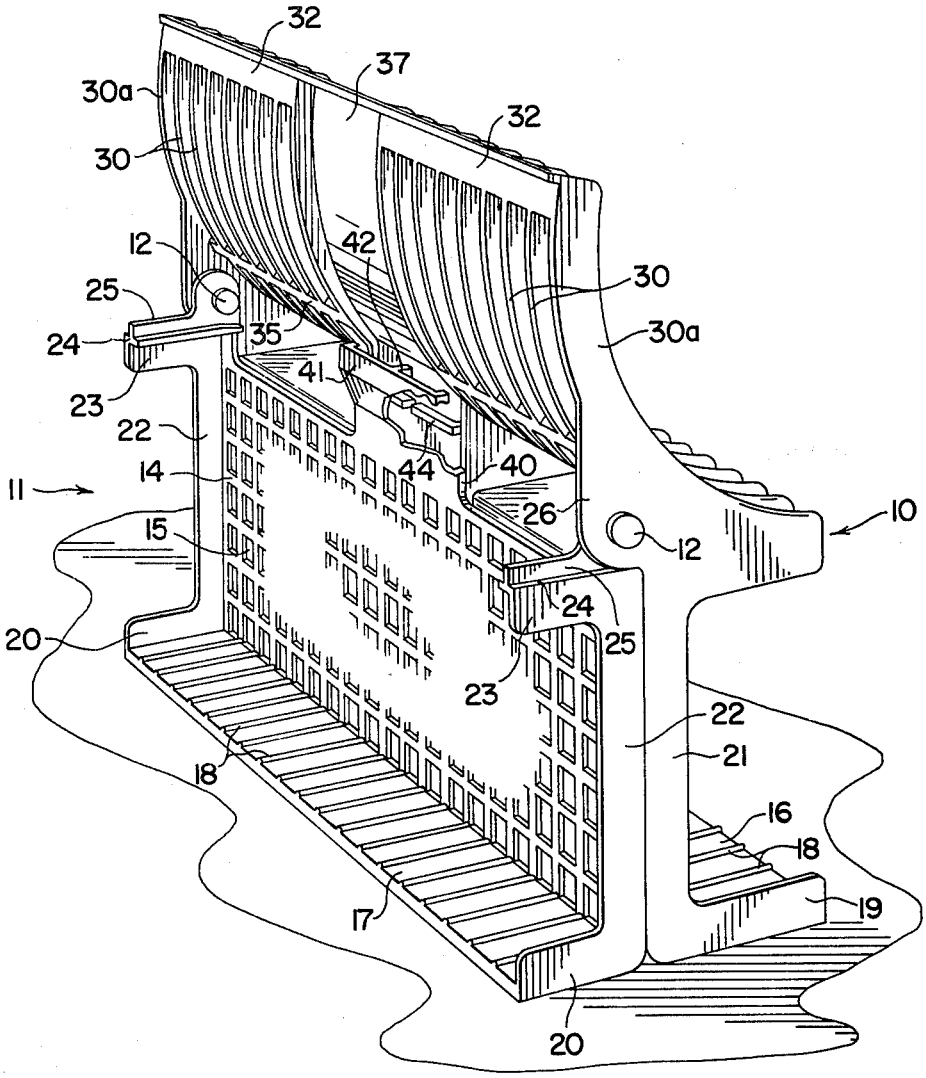
FIG. 7 is a perspective view of the drainer in folded position directed toward the side opposite to that in FIG. 1.

Referring to FIGS. 1 and 7, the improved folding dish drainer has two wings indicated generally at 10 and 11 which are hinged together by pivot pins 12 for folding together in the storage positions of FIG. 7 and for swinging apart to the in-use position of FIG. 1.

The wings 10 and 11 have flat inner walls 13 and 14, respectively, which have a plurality of perforations 15, and the walls substantially abut each other back-to-back in the vertical closed position of FIG. 7. The walls 13 and 14 have bottom outwardly extending angular support flanges 16 and 17, preferably with a series of longitudinally spaced lateral ribs 18 on their upper surfaces.

The support flanges 16 and 17 have retainer flanges 19 and 20, respectively, at their ends and these flanges merge into co-planar retainer flanges 21 and 22, respectively, at the ends of the inner walls 13 and 14, respectively. Co-planar flanges 23 extend angularly outward from the upper ends of flanges 22 and have narrow top ledges 24 thereon from which upright bracket flanges 25 extend to receive the pivot pins 12. The ledges 24 serve as stop abutments for bracket flanges 26 on the wing 10 in the unfolded position of FIG. 1.

Figure 2:
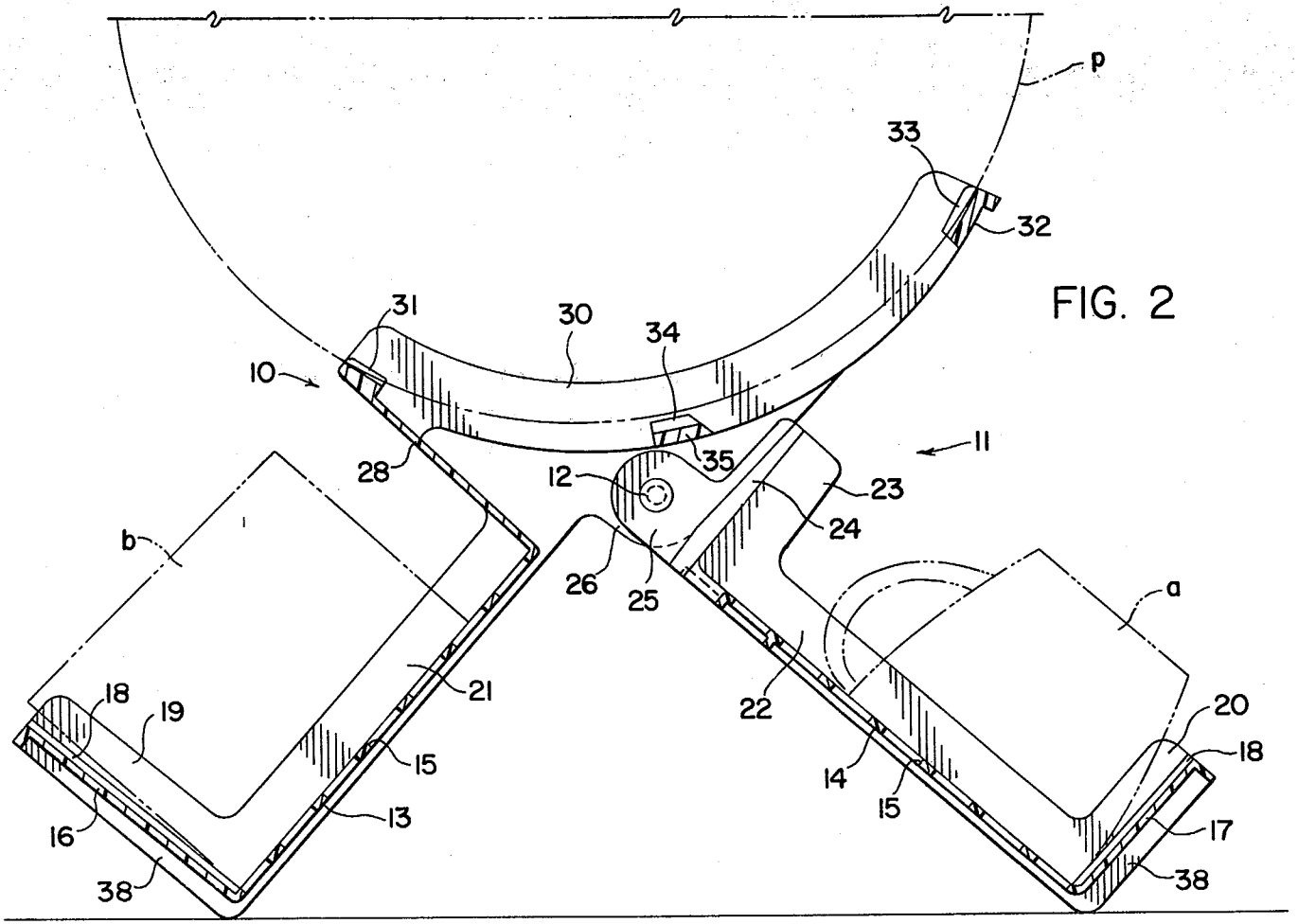
FIG. 2 is an enlarged cross-sectional view as on line 2—2 of FIG. 1.
Figure 6:
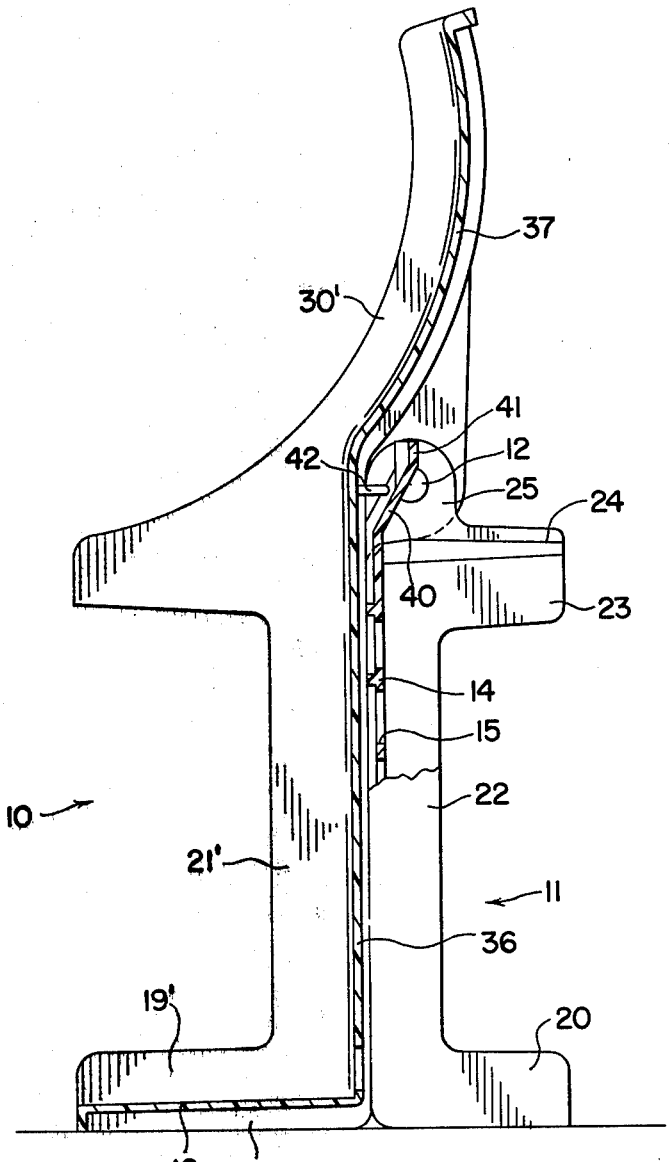
FIG. 6 is a vertical sectional view similar to FIG. 4 with the drainer in folded position.

The wing 10 has upper support flanges 28 extending angularly outward from the upper edge of inner wall 13, preferably parallel to the bottom support flange 16, as best shown in FIGS. 1 and 2. Two longitudinal series of laterally extending spaced-apart arcuate ribs 30 extend upwardly from the outer ends of upper support flanges 28, the lower ends of the ribs being connected to the outer edges of flanges 28 with support abutments 31 formed between the ribs.

Preferably, the ribs **30*a* at opposite ends of the wing 10 are co-planar with the bracket flanges 26, and the ribs 30 and 30*a* are connected at their upper ends to longitudinal bars 32 forming abutments 33 between the ends of the ribs. Abutments 34 are formed between intermediate portions of the ribs on longitudinal bars 35**, for a purpose to be described.

A cutlery channel or tray is formed in the wing 10, preferably medially thereof and extends upwardly from bottom flange 17 between the two series of ribs 30 (FIGS. 1 and 4). The bottom web 36 of the lower part of the channel is a part of inner wall 13 and the sides of the channel are flanges 19' and 21' parallel to end flanges 19 and 21. The bottom web 37 of the upper part of the channel is curved to conform to the curvature of ribs 30 and connects at its upper end with the bars 32 (FIG. 7). The sides of the upper portion of the channel are formed by inner ribs 30'. As indicated, the flanges 19 and 21 and 19' and 21' may extend slightly below the bottom flange 16 to provide ribs 38 and 39 on its bottom surface. Similarly, the end flanges 20 and 22 may extend slightly below the bottom flange 17 to provide ribs 39 thereon.

As shown in FIGS. 4–7, a tongue 40 projects upwardly from the central portion of the upper edge of inner wall 14 of wing 11. The upper part of the tongue 40 is outwardly inclined and terminates in a channel flange 41 having a medial inner rib 42 (FIGS. 5 and 7). When the wings 10 and 11 are swung apart to the unfolded position, the rib 42 enters a slot between two longitudinal ribs 44 on the under surface of web 37 and abuts the web to support and stabilize the cutlery channel in wing 10. Preferably, the outer ends of ribs 44 are received within the outer legs of channel flange 41 to further stabilize the wing 10.

In the unfolded position, plates or dishes p may be supported edgewise between the upper ribs 30, as shown in FIG. 1, by inserting the rims of the plates between the ribs. Depending upon the size of the plates, the rims may be supported by one or both of the end abutments 31 and 33 and intermediate abutment 34, or by the end abutments only, as indicated in phantom in FIGS. 2 and 3.

Cups a and glasses b may be supported on the bottom flanges 16 and 17 and adjoining perforate walls 13 and 14, respectively, as shown in FIGS. 1 and 2, and cutlery c is supported in substantially upright position in the separate cutlery channel.

It will be apparent from FIGS. 1 and 7 that when the wings are unfolded to the position of FIG. 1, the end bracket flanges 26 of wing 10 will abut the ledges 24 on flanges 23 of wing 11, thus providing stop abutments in addition to the abutment of medial rib 42 against the inner or rear surface of web 37 of the cutlery tray.

The construction of the upper curved rib portion of the wing 10 is designed to provide an overall height in the folded position of FIG. 7 which will fit on a counter top underneath an upper conventional cupboard spaced a standard height above the counter top, and at the same time support large diameter plates as well as smaller ones between the ribs in the unfolded position.

The entire drainer, except for the pivot pins 12, is preferably made of molded high heat, high impact styrene, so as to be rigid, durable, non-toxic and extremely stable in unfolded position.

I claim:

1. A folding dish drainer of molded plastic material comprising two wings hinged together and having substantially flat inner walls adapted for abutting each other in folded position and for swinging apart laterally into unfolded position, one of said wings having an extended upper portion comprising a longitudinal series of spaced-apart laterally extending arcuate ribs with abutments therebetween for receiving and supporting the rims of plates in upright edgewise positions, said flat inner walls having bottom angular support flanges, and walls forming a separate channel for containing cutlery in said one wing extending upwardly from the bottom flange thereof and into said extended upper portion.

2. A folding dish drainer as defined in claim 1, wherein an upwardly projecting tongue on said other wing abuts and supports the underside of said channel in the unfolded position.

3. A folding dish drainer as defined in claim 2, wherein said flat inner walls and angular support flanges have retaining flanges at their ends.

4. A folding dish drainer as defined in claim 3, wherein the overall height of said extended upper portion in folded position is adapted to fit on the counter top under the bottom shelf of a conventional kitchen upper cupboard.

5. A folding dish drainer as defined in claim 1, wherein said flat inner walls are perforated and have retaining flanges at their ends.

6. A folding dish drainer as defined in claim 5, wherein an upwardly projecting tongue on said other wing abuts and supports the underside of said channel in the unfolded position.

7. A folding dish drainer as defined in claim 1, wherein said abutments between the ribs are spaced apart laterally so as to hold plates of various sizes upright edgewise with their rims between said ribs.

8. A folding dish drainer as defined in claim 7, wherein stop abutments are provided on said wings to limit their unfolding movement.

9. A folding dish drainer as defined in claim 7, wherein said flat inner walls are perforated and have retaining flanges at their ends.

10. A folding dish drainer as defined in claim 9, wherein stop abutments are provided on said wings to limit their unfolding movement.

* * * * *